US012637739B2

(12) United States Patent
Barbarossa et al.

(10) Patent No.: US 12,637,739 B2
(45) Date of Patent: May 26, 2026

(54) REINFORCED METAL MATRIX COMPOSITES AND METHODS OF MAKING THE SAME

(71) Applicant: II-VI Delaware, Inc., Wilmington, DE (US)

(72) Inventors: Giovanni Barbarossa, Saratoga, CA (US); Allyn Mccormick, Wilmington, DE (US); Sam Salamone, Wilmington, DE (US); Sean Mcanany, Wilmington, DE (US); Michael Aghajanian, Wilmington, DE (US)

(73) Assignee: II-VI DELAWARE, INC., Wilmington, DE (US)

( * ) Notice: Subject to any disclaimer, the term of this patent is extended or adjusted under 35 U.S.C. 154(b) by 0 days.

(21) Appl. No.: 17/823,704

(22) Filed: Aug. 31, 2022

(65) Prior Publication Data

US 2024/0068073 A1 Feb. 29, 2024

(51) Int. Cl.
*C22C 1/10* (2023.01)
*C22C 21/00* (2006.01)

(52) U.S. Cl.
CPC ..... *C22C 1/1036* (2013.01); *C22C 1/1021* (2023.01); *C22C 21/00* (2013.01)

(58) Field of Classification Search
CPC ..... B22F 3/1143; C22C 1/10; C22C 1/1015; C22C 1/1068; C22C 49/00; C04B 35/65; C04B 35/651
See application file for complete search history.

(56) References Cited

U.S. PATENT DOCUMENTS 5,620,804 A * 4/1997 Kennedy ..... C22C 32/0068 428/614
5,626,914 A * 5/1997 Ritland ..... B01D 29/31 427/431
5,720,868 A * 2/1998 Rendall ..... C01F 7/748 205/372
2004/0149569 A1 8/2004 De
2007/0125458 A1* 6/2007 Kawasaki ..... C22C 9/06 148/414
2011/0135948 A1 6/2011 Pyzik et al.
2016/0214174 A1* 7/2016 Suzuki ..... C22F 1/043
2016/0373154 A1 12/2016 Barbarossa et al.

FOREIGN PATENT DOCUMENTS

CN 110724847 A 1/2020
EP 0368781 A1 5/1990

OTHER PUBLICATIONS

Karandikar, P , et al., "Al/Al2O3 MMCs and Macrocomposites for Armor Applications", Ceramic Engineering & Science Proceedings, 2013, 34 [5] , p. 63-74.

(Continued)

*Primary Examiner* — Jie Yang
(74) *Attorney, Agent, or Firm* — Blank Rome LLP

(57) ABSTRACT

Reinforced metal matrix composites are described including a porous ceramic reinforcement and a metal matrix in interstitial contact with the ceramic reinforcement. Methods of forming reinforced metal matrix composites are described including contacting a porous ceramic reinforcement with a liquid metal matrix and solidifying the liquid metal matrix.

22 Claims, 9 Drawing Sheets

(56) References Cited

OTHER PUBLICATIONS

Jamshidi, Farshid , et al., "A 3D Computational Method for Determination of Pores Per Inch (PPI) of Porous Structures", Materials Today Communications (XP093120884), 2023, 34:105413, 11 pages.
Metals & Alloys in the Unified Numbering System, 13th Edition, ISBN 978-0-7680-8421-4.

* cited by examiner

150

DETAIL A

REINFORCED METAL MATRIX COMPOSITES AND METHODS OF MAKING THE SAME

BACKGROUND

Modern structural applications, including those used in aerospace, automobiles, consumer electronics, and industrial applications, often require materials that have differing properties. For example, a material's: strength-to-weight ratio; stiffness (how much a material deflects under a given load); ductility (the amount of plastic deformation under tensile stress a material may undergo before failure); coefficient of thermal expansion (CTE) (the rate at which a material expands due to change in temperature); thermal conductivity (the rate at which heat is transferred by conduction through the material) all factor into selecting a material for different applications. While changes to a material may provide favorable gains in one material property, it may impact other material properties.

US Publication 2016/0373154 (application Ser. No. 15/175,840, filed Jun. 7, 2016) (the '154 Publication") describes an electronic device housing utilizing a metal matrix composite (MMC), the entirety of which is incorporated by reference herein. The '154 publication describes using a particle-reinforced aluminum alloy MMC with a reinforcement content of 55 vol. % (Al/SiC-55 p) for improved stiffness over other materials in-use. Other properties of particle-reinforced MMC are described in Karandikar et. al, *Al/Al2O3MMCs AND MACROCOMPOSITES FOR ARMOR APPLICATIONS*, Ceramic Engineering & Science Proceedings 34 |5| (2013) pg. 63-74, the entirely of which is incorporated by reference herein. However, further improvements are needed.

BRIEF SUMMARY

In one aspect of the disclosure, reinforced metal matrix composites are described, including, for example, a porous ceramic reinforcement having pores therein, and a metal matrix in interstitial contact with the ceramic reinforcement within the pores. In another aspect of the disclosure, a porous ceramic reinforcement is interconnected. In another aspect of the disclosure, a porous ceramic reinforcement is from about 10 percent to about 20 percent by volume of the reinforced metal matrix composite. In yet another aspect of the disclosure, the porous ceramic reinforcement is continuous from a first end of the reinforced metal matrix composite to a second end of a reinforced metal matrix composite. In another aspect of the disclosure, a size of the pores is from about 10 pores per inch (PPI) to about 50 PPI. In another aspect of the disclosure, a ceramic reinforcement has a nominal porosity of about 80%.

In one aspect of the disclosure a metal matrix comprises aluminum. In another aspect of the disclosure a porous ceramic reinforcement comprises aluminum oxide. In one aspect of the disclosure a metal matrix comprises ceramic particles. In another aspect of the disclosure, the ceramic particles comprise agglomerated aluminum oxide particles. In one particular aspect of the disclosure, agglomerated aluminum oxide particles comprise bonded aluminum oxide crystals having a diameter of from about 100 microns to about 200 microns. In another aspect of the disclosure the metal matrix comprises a metal alloy.

Disclosed herein are methods of forming a reinforced metal matrix composite. In one aspect of the disclosure, a method includes providing a porous ceramic reinforcement having pores therein, contacting the porous ceramic reinforcement with a liquid metal matrix, and solidifying the liquid metal matrix. In another aspect of the disclosure, providing a porous ceramic reinforcement includes applying a ceramic to a polymer foam and sintering the ceramic. In another aspect of the disclosure a method includes adding ceramic particles to a liquid metal matrix. In another aspect of the disclosure, the ceramic particles are added to the porous ceramic reinforcement prior the liquid metal matrix. In yet another aspect of the disclosure, ceramic particles are added to a liquid metal matrix prior to contacting the porous ceramic reinforcement with the liquid metal matrix. In a further aspect of the disclosure, ceramic particles may include agglomerated aluminum oxide particles.

Disclosed herein are methods of forming a reinforced metal matrix composite.

In one aspect of the disclosure, a porous ceramic reinforcement is interconnected. In another aspect of the disclosure, a porous ceramic reinforcement is from about 10 percent to about 20 percent by volume of a reinforced metal matrix composite. In yet another aspect of the disclosure, a porous ceramic reinforcement is continuous from a first end of the reinforced metal matrix composite to a second end of the reinforced metal matrix composite. In another aspect of the disclosure, a size of the pores is from about 10 pores per inch (PPI) to about 50 PPI. In a further aspect of the disclosure a ceramic reinforcement has a nominal porosity of about 80%. In another aspect of the disclosure, a metal matrix comprises aluminum. In another aspect of the disclosure the porous ceramic reinforcement includes aluminum oxide. In yet a further aspect of the disclosure, the disclosed methods may include machining at least one surface of the reinforced metal matrix composite.

DETAILED DESCRIPTION

Figure 1:
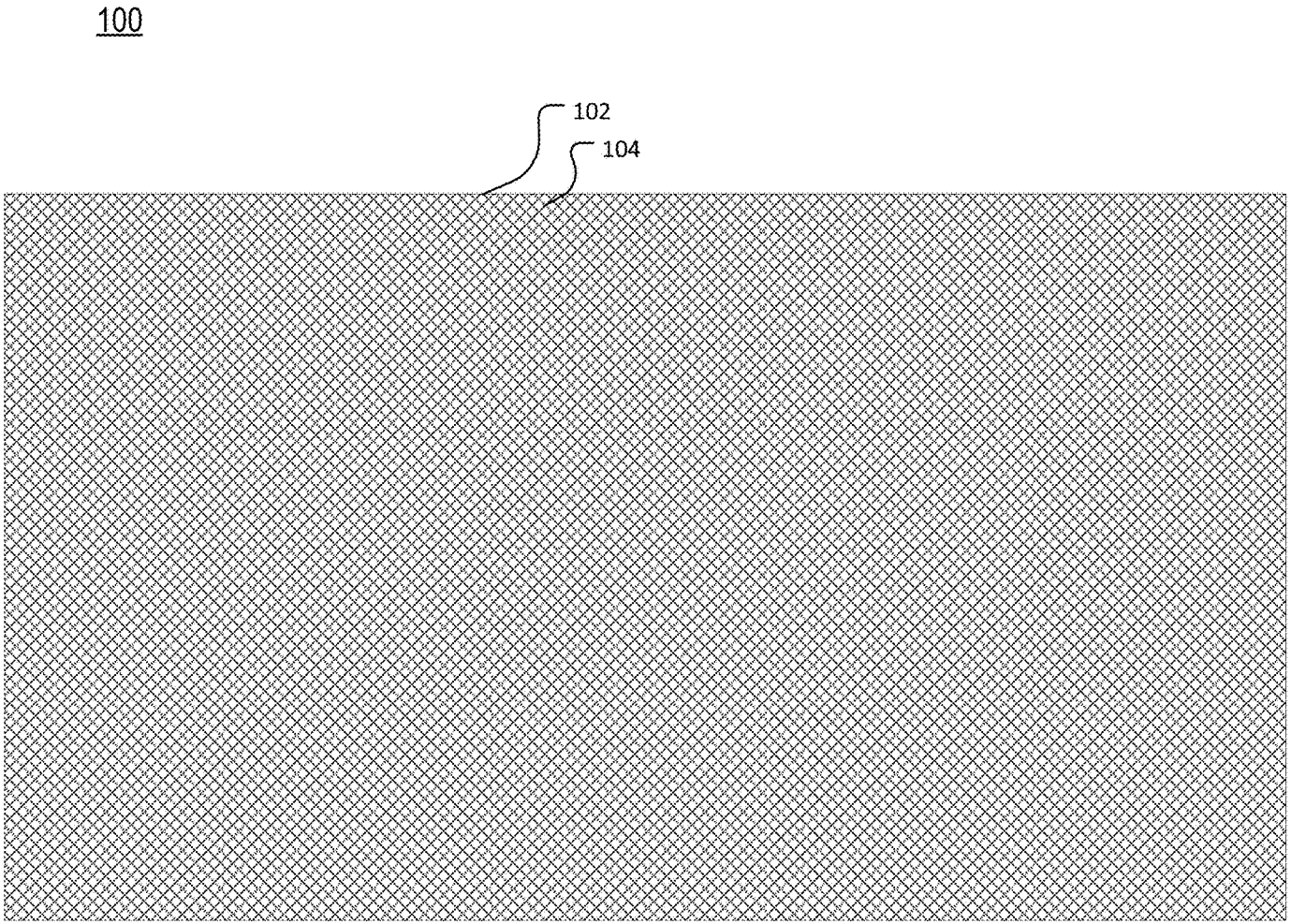
FIG. 1 is a schematic of reinforced metal matrix composite, in accordance with disclosed embodiments.

As noted previously, many applications require materials that have differing properties. For example, many aerospace or mobile applications may call for materials having a high strength to weight ratio that are not necessary in less mobile applications. Further, applications that undergo increased shock and vibration may call for materials that are more ductile. Many types of electronic devices that are used for communication and/or entertainment purposes are relatively small; that is, configured to be hand-held, portable, or mobile devices, e.g. mobile telephone, tablets, laptops, and other wearable or hand carried devices. While needing to be sufficiently rugged to protect the complex electronics and communication components forming such a device, its outer housing (also referred to at times as a chassis, case, or shell) also needs to be relatively thin and lightweight for the comfort and convenience of the user. This is also true in other industrial environments where size and weight are a design criteria.

For example, steel is an attractive construction material for elements that require high stiffness. However, steel also has a high density, which leads to high component mass. Aluminum is can also be an attractive construction material for lightweight structural elements, since its density is significantly lower than steel. However, aluminum exhibits a very low stiffness, which leads to unwanted bending. Bending of an electronic or other sensitive device can lead to catastrophic damage. For example, there have been reports of consumer complaints regarding bending problems associated with lightweight electronic housings.

Besides the needs for lightweight, yet durable, consumer electronics housings, various commercial electronic devices (particularly, military) also derive benefits from a housing that provides the desired degree of stiffness/strength for a wide range of environmental factors, yet is lighter in weight than housings made of steel or other high-strength materials. The same is true in other industries where weight and impact resistance is a factor in the design. For example, aerospace applications (e.g., landing gear, struts, ramps, satellite components, etc.) and automotive components (e.g., connecting rods, brake calipers, pistons, piston pins, etc.).

As noted previously, the '154 publication describes using a particle-reinforced aluminum alloy MMC with a reinforcement content of 55 vol. % (Al/SiC-55 p) for improved stiffness over other materials in-use. However, such a solution also produces a relatively brittle material (low ductility). Such low ductility would typically stem from the relatively high amount of SiC content required to obtain the desired stiffness in most applications and additional silicon added to the aluminum matrix alloy to prevent unwanted Al—SiC reactions occurring between the particle reinforcement and the aluminum alloy.

Disclosed herein are reinforced metal matrix composites and methods for forming reinforced metal matrix composites suitable for structural applications where both stiffness and ductility are needed. Example disclosed reinforced metal matrix composites include a ceramic reinforcement which is porous and/or interconnected in that the ceramic components are bonded to each other. An example porous ceramic reinforcement includes ceramic structures that form pores in three dimensions such that the resulting structural material has both increased stiffness and ductility.

FIG. 1 (not drawn to scale) shows a schematic of a reinforced metal matrix composite 100. The metal matrix composite includes a porous ceramic reinforcement 102 and a metal matrix 104 within and surrounding the porous ceramic reinforcement 102, interstitially. The metal matrix composite 100 may be formed to be any size or shape. The porous ceramic reinforcement 102 is interconnected, in that it forms internal ceramic bonds throughout the porous ceramic reinforcement 102. The porous ceramic reinforcement 102 may also be continuous, or un-broken, from one end of the reinforced metal matrix composite 100 to an opposite end, in any dimension, or all dimensions. While reinforced metal matrix composite 100 could contain subsets of "broken" porous ceramic reinforcements, such configurations will decrease the stiffness for the same volume of porous ceramic reinforcement. Accordingly, to achieve the same stiffness, a higher amount of ceramic would be required, which could decrease the ductility of the resulting material by decreasing the amount of metal matrix 104 accordingly. The porous ceramic reinforcement 102, in one example, is from about 10 percent to about 20 percent by volume of the reinforced metal matrix composite 100, and in another example from about 15 percent to about 18 percent by volume of the reinforced metal matrix composite 100, and in another example about 17 percent by volume of the reinforced metal matrix composite 100.

The porous ceramic reinforcement 102 may be any suitable ceramic having the desired bonding or structural properties. In one example, the porous ceramic reinforcement 102 is made of, or includes, aluminum oxide, for example, $Al_2O_3$. The porous ceramic reinforcement 102 may also be made entirely of aluminum oxide. Alternatively, the porous ceramic reinforcement 102 may be made from or include alumina, silicon carbide, zirconia, bonded carbon, silica (silicon oxide), titania (titanium oxide), iron oxide, an alkali, and/or combinations thereof.

The metal matrix 104 may be any appropriate metal or metal alloy suitable for the chosen porous ceramic and desired structural properties of the resulting composite. For example, in one example, metal matrix 104 may be pure aluminum or an aluminum alloy, for example 6061 aluminum (having unified numbering system (UNS) designation A96061 according to SAE International publication "Metals & Alloys in the Unified Numbering System, 13th Edition," ISBN 978-0-7680-8421-4, which is hereby incorporated by reference in its entirety). In another example, metal matrix 104 may be an Al—Mg alloy, where the Mg promotes wetting of the alloy to the porous ceramic reinforcement 102. For example, the Al—Mg alloy could include from about 0.5 to about 10 weight percent of magnesium.

The metal matrix 104 permeates the pores of the porous ceramic reinforcement 102 such that metal matrix 104 is present interstitially within the porous ceramic reinforcement 102, e.g., within the pores of the porous ceramic reinforcement 102. As shown in FIG. 1, the porous ceramic reinforcement 102 is present within the metal matrix 104 from end to end in each dimension. Such a configuration allows for machining or plating the reinforced metal matrix composite 100 while maintaining uniformity of the reinforced metal matrix composite 100.

Figure 2:
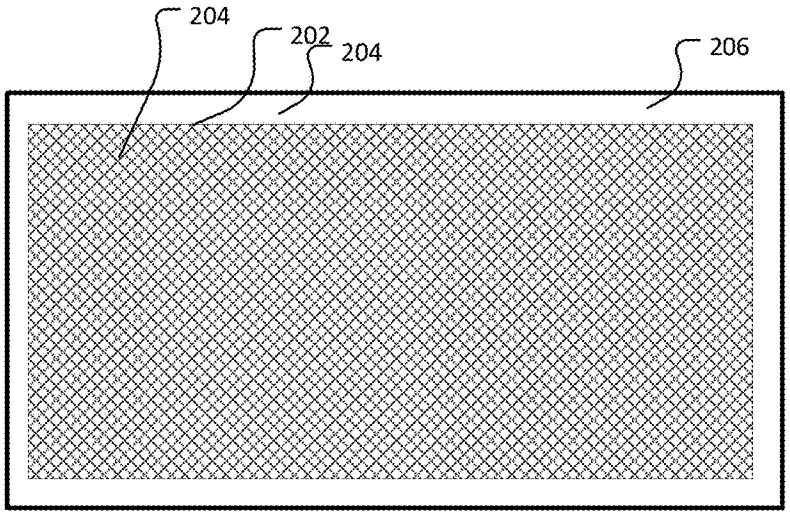
FIG. 2 is a is a schematic of reinforced metal matrix composite, in accordance with disclosed embodiments.

Alternatively, as shown in FIG. 2, the metal matrix 204 may extend past the ends (in any dimension of porous ceramic reinforcement 202 such that there are regions 206 or "skins" of reinforced metal matrix composite 150 containing no porous ceramic reinforcement 202. The remaining features of reinforced metal matrix composite 150 are the same as reinforced metal matrix composite 100, including its alternative configurations and components. It should be noted that while reinforced metal matrix composite 150 is a viable solution, the existence of skins of metal matrix 204 may, in certain situations, lead to bi-metallic stresses due to potential differences in stiffness and CTE. However, such configurations may be desirable where completely smooth metallic skin finishes are desired.

Figure 3:
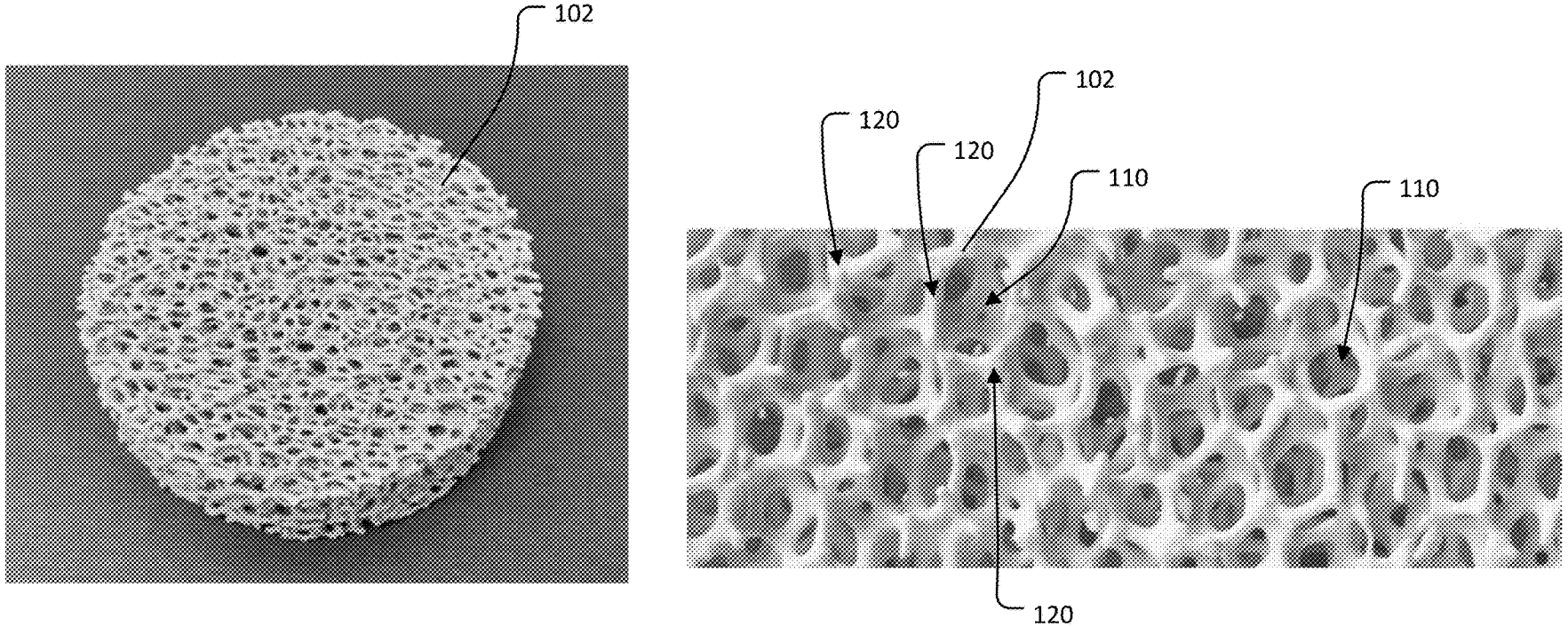
FIG. 3 shows photographs of a porous ceramic reinforcement, in accordance with disclosed embodiments.

FIG. 3 shows two photographs of similar example porous ceramic reinforcements 102 at two different scales. While the porous ceramic reinforcement 102 is shown having an overall disk or cylindrical shape, it should be noted that the porous ceramic reinforcement 102 may be any shape or size based on the overall designed shape of the reinforced metal matrix composite 100. That is, the size and shape of the porous ceramic reinforcement 102 should be chosen or formed based on the desired shape of the resulting reinforced metal matrix composite 100. This may include, for example, irregular edges, or large voids in the middle of the porous ceramic reinforcement 102 if such irregular edges or voids are desirous in the reinforced metal matrix composite 100. Accordingly, such examples provide for advantageous manufacturing techniques, as will be discussed below, because the metal matrix 104 will wick to within and form to the shape of the ceramic reinforcement 102.

Porous ceramic reinforcement 102 includes pores 110 contained or formed therein as defined by the interconnected or bonded ceramic structures 120. The ceramic structures 120 extend in different directions forming a three-dimensional lattice of ceramic structures 120 and corresponding pores 110. The example ceramic structures 120 of FIG. 3 are made primarily of aluminum oxide, e.g, $Al_2O_3$, but as noted previously, may contain other materials as well. Porous ceramic reinforcement 102 may be made, for example, by dipping a polymer-based foam in a ceramic slip to coat the polymer foam and then sintering the coated foam at a temperature sufficient to bond the ceramic slip and vaporize the polymer foam leaving behind the porous ceramic reinforcement 102. Following sintering, the ceramic structures 120 may contain further voids within the ceramic structures at the former locations of the polymer-based foam, which would be vaporized by the sintering process.

Porous ceramic reinforcement 102 may also be obtained commercially, for example, as foundry filters typically used to filter flowing liquid metal. For example, filters sold commercially by ASK Chemicals under the tradenames UDICELL and EXACTFLO, specifications for which are available at: https://www.ask-chemicals.com/fileadmin/user_upload/Download_page/foundry_products_brochures/EN/Minibooklet_Filters_EN.pdf and https://www.ask-chemicals.com/products-services/filters/exactflo-filters, the entire contents of each of which are incorporated by reference herein. Another example of a material suitable for an alumina based porous ceramic reinforcement 102 is available from ASK Chemicals under the tradename Alucel-LT, which contains 17.6% $SiO_2$, 0.32 $TiO_2$, 81.6% $Al_2O_3$, 0.23% $FeO_3$, and 0.24% Alkali (each percentage by weight) and having bulk density of 0.51 g/cm$^3$ and a porosity of about 80-85% (a fraction of the volume of the voids or pores over the total volume expressed as a percentage). Other examples are available from SELEE Corporation and sold under the trade names "Ceramic Foam Filters," "Zirconia PRZ filters" (magnesia-stabilized zirconia), and "SELEE® Advanced Ceramics® kiln fumiture."

Figure 4:
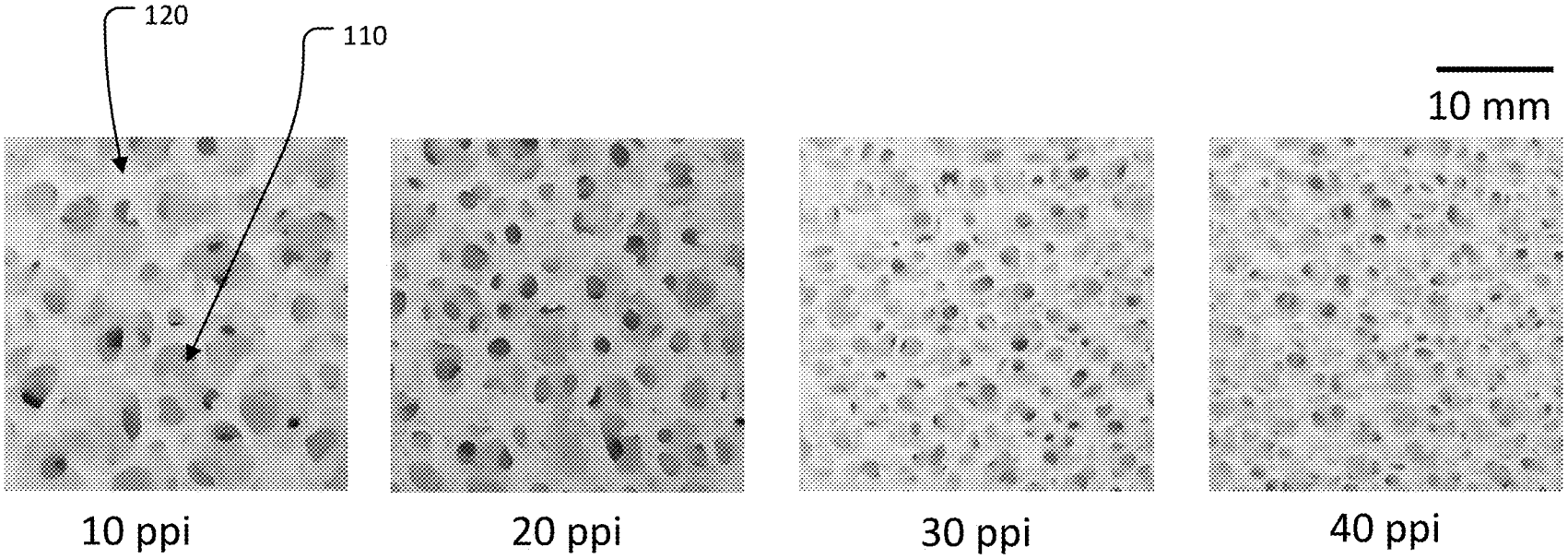
FIG. 4 shows photographs of example porous ceramic reinforcements, in accordance with disclosed embodiments.

Further, as shown in FIG. 4, for each porosity, a range of pore sizes is also available to provide alternatives for porous ceramic reinforcement 102. Each of the examples shown in FIG. 4 have a nominal porosity of 80%, the number of pores per inch (PPI) is shown. As the number of PPI increases, the size of each pore 110 decreases without nominally changing the porosity or density. Further, both the porosity and the PPI can be varied. As the porosity of the porous ceramic reinforcement 102 increases, the resulting reinforced metal matrix composite 100 will have a decreased stiffness and an increased ductility, and as the PPI of the porous ceramic reinforcement 102 increases, the resulting reinforced metal matrix composite 100 will have an increased strength. In certain examples, a reinforced metal matrix composite 100 having a porous ceramic reinforcement 102 with a porosity of about 80-85% and having between about 20 ppi to about 50 ppi exhibited advantageous stiffness and ductility. However, the pore 110 size can continue to decrease (higher PPI) and still be advantageous so long as the metal matrix 104 is able to flow or wick through the porous ceramic reinforcement 102 to interstitially fill the pores 110.

Figure 5:
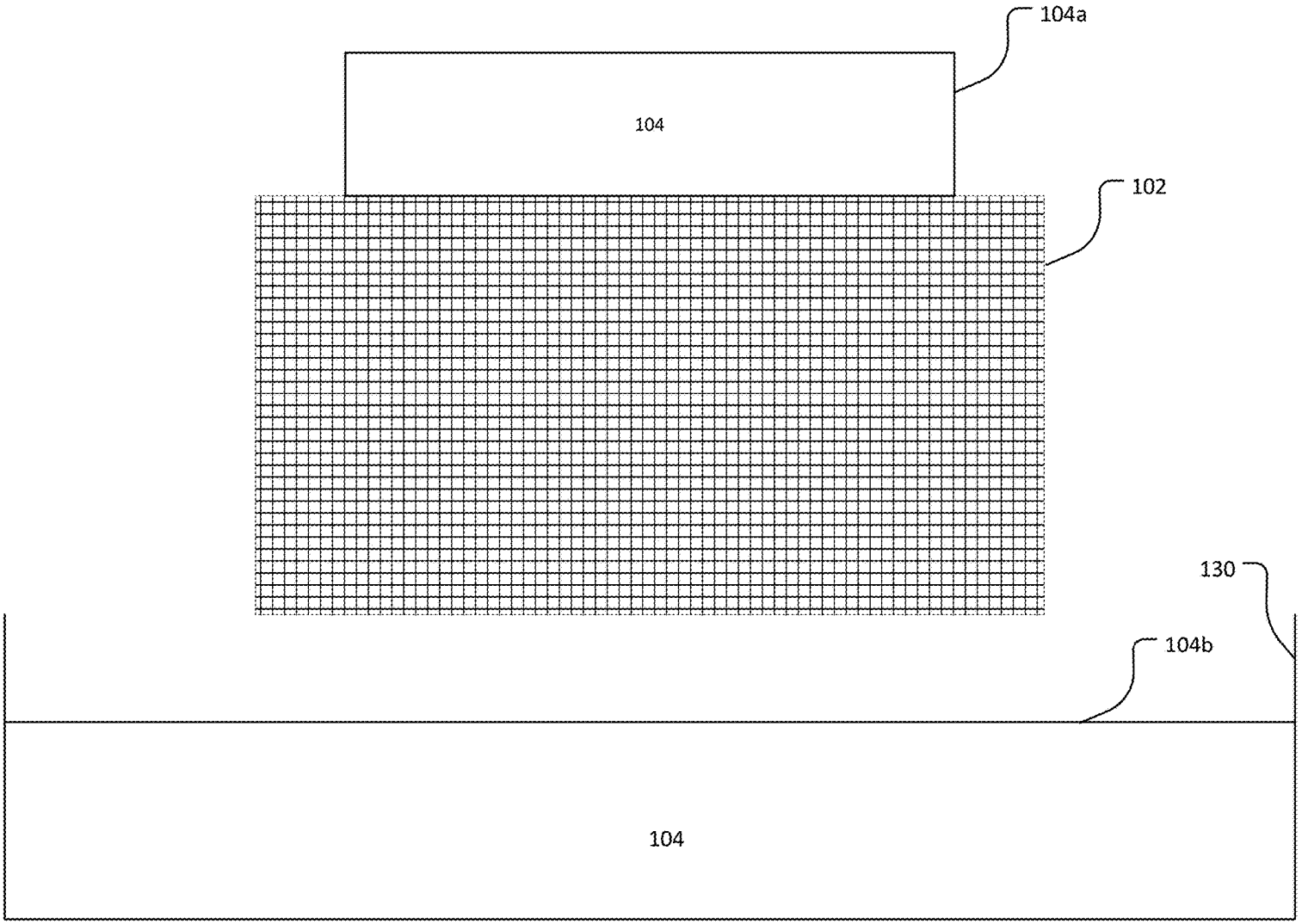
FIG. 5 shows a schematic of methods of making reinforced metal matrix composites, in accordance with disclosed embodiments.

With reference to FIG. 5, methods will be discussed for forming a reinforced metal matrix composite 100. A porous ceramic reinforcement 102 is provided, which may be obtained commercially or formed, as discussed previously for example, through the sintering of a ceramic coated polymer-based foam. The metal matrix 104 is liquified by heating the metal matrix 104. Metal matrix 104 may be contacted with the porous ceramic reinforcement 102 from any direction. As shown, in FIG. 5, metal matrix 104 may be liquified beneath the porous ceramic reinforcement 102 (reference **104*b*) within a vessel 130. In such an example embodiment, the porous ceramic reinforcement 102 may be lowered to liquified metal matrix 104*b* (or alternatively the vessel 130 raised) until porous ceramic reinforcement 102 at least contacts the surface of liquified metal matrix 104*b*. At which point the liquified metal matrix 104*b* will, through capillary or "wicking" action, be drawn into the porous ceramic reinforcement 102 interstitially filling the pores 110 (FIG. 3) and flowing throughout the porous ceramic reinforcement 102. A pre-liquified metal matrix 104 may also be poured on top of or introduced to the porous ceramic reinforcement 102** from any direction.

Alternatively, or in addition, to utilizing a pre-liquified metal matrix **104*b*, metal matrix 104 may be placed in contact with the porous ceramic reinforcement 102 as a solid metal matrix 104*a*, for example (as shown in FIG. 5) on top of the porous ceramic reinforcement 102. The metal matrix 104*a* may then be heated above its melting point, at which point the now liquified metal matrix 104*a* will, through capillary or "wicking" action and gravity, be drawn into the porous ceramic reinforcement 102 interstitially filling the pores 110 (FIG. 3). In either method (or jointly), once the metal matrix 104 cools, the reinforced metal matrix composite 100 (FIG. 1**) results, which may then be machined, plated, or otherwise worked.

Figure 6:
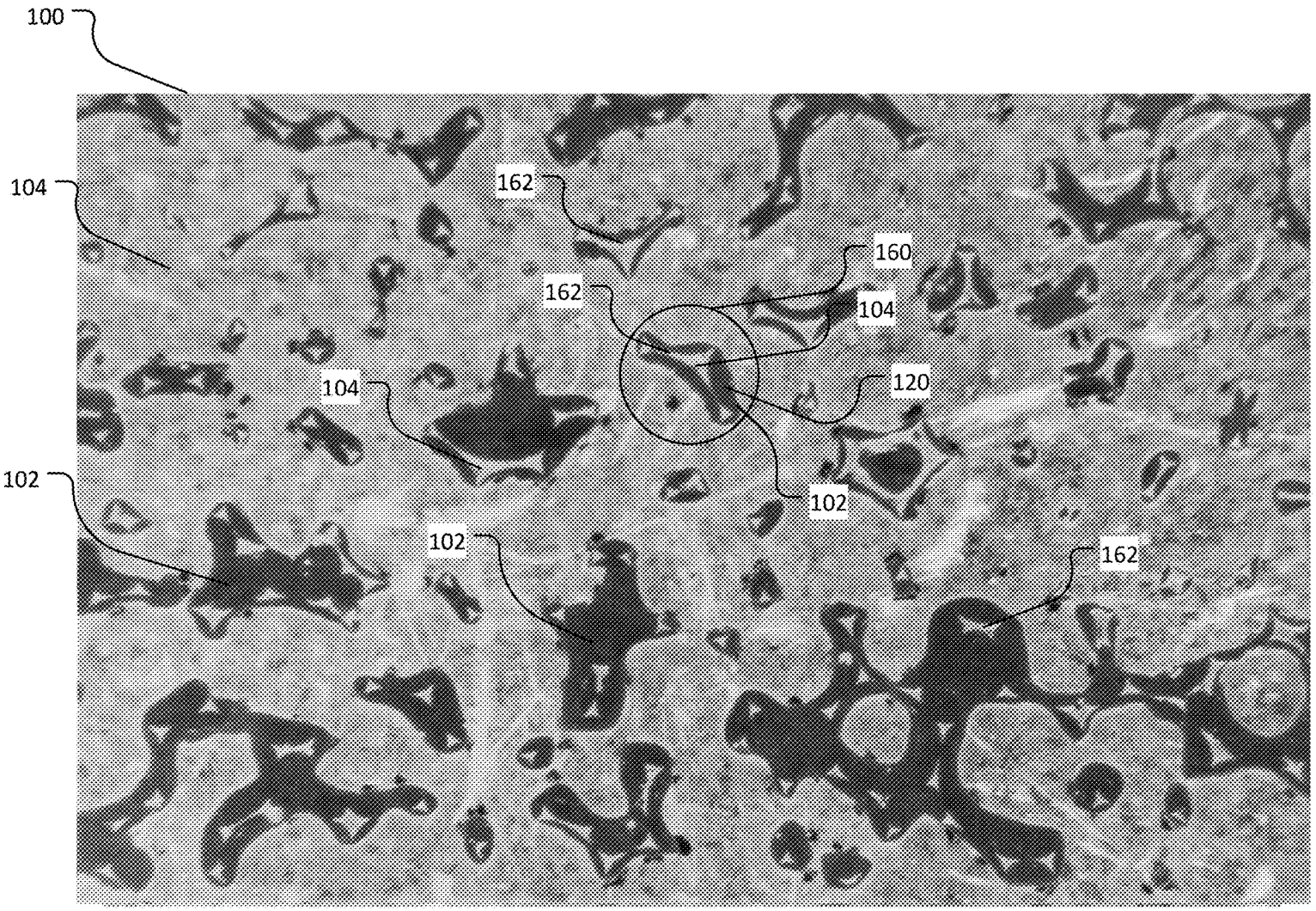
FIG. 6 is a photograph of a cross section of a reinforced metal matrix composite, in accordance with disclosed embodiments.

FIG. 6 is a photograph of a cross section of an example reinforced metal matrix composite 100. The darker areas show the porous ceramic reinforcement 102, which in this example is $Al_2O_3$. The lighter areas show the metal matrix 104, which can be seen surrounding the porous ceramic reinforcement 102 and filling the pores of the porous ceramic reinforcement 102. Also shown at detail 160 is a void 162 within the bonded ceramic structures 120 of the porous ceramic reinforcement 102. In this example, the void 162 was previously occupied by the polymer-based foam used in forming the porous ceramic reinforcement 102. During sintering, the polymer-based foam was vaporized while the bonded ceramic structures 120 were being formed around it leaving behind small voids within the bonded ceramic structures 120. When the porous ceramic reinforcement 102 was later infiltrated with the metal matrix 104, that metal matrix also filled the voids 162 within the bonded ceramic structures 120 in addition to the pores 110.

Figure 7:
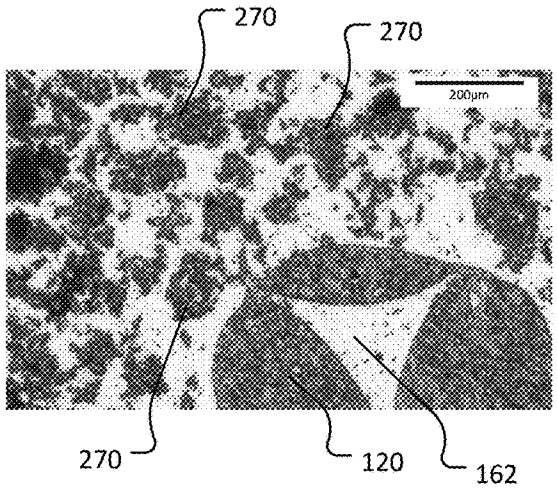
FIG. 7 is a photograph of a cross section of a reinforced metal matrix composite, in accordance with disclosed embodiments.
Figure 7:
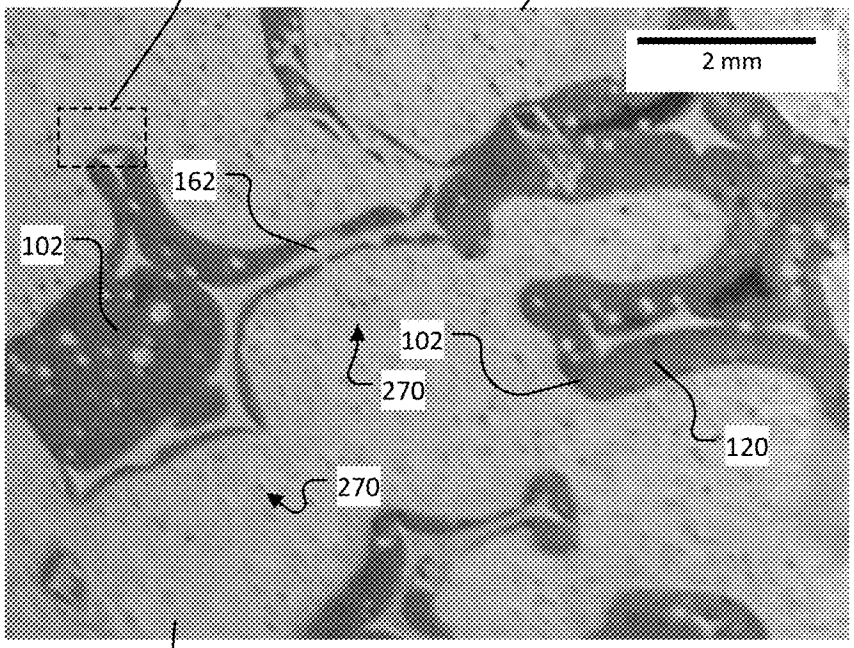

Optionally, the reinforced metal matrix composites may also include particle reinforcement in addition to the reinforcement provided by porous ceramic reinforcement. FIG. 7 shows a cross section photograph of one example embodiment of a reinforced metal matrix composite 200. Like reference numerals refer to similar features described previously. Reinforced metal matrix composite 200 is similar in all respects to the example reinforced metal matrix composites 100 described previously including all variable or optional alterations discussed previously. However, reinforced metal matrix composite 200 also includes ceramic particles 270 (shown as dark dots) that are within the metal matrix 104.

Figure 8:
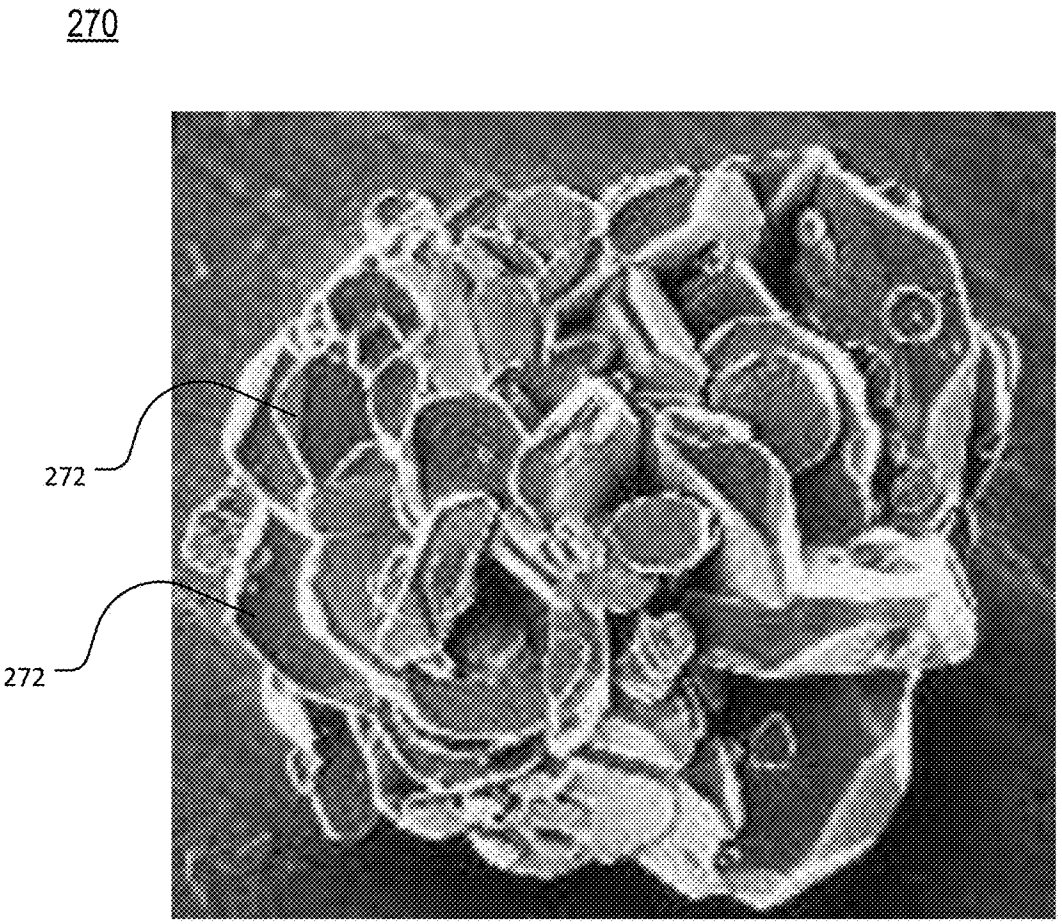
FIG. 8 is photograph of an agglomerated ceramic particle, in accordance with disclosed embodiments.

The ceramic particles 270 may be any ceramic particles known in the art, including those previously used in particle reinforced MMC. Ceramic particles 270 may also include agglomerated ceramic particles, for example agglomerated aluminum oxide particles. Agglomerated ceramic particles are bonded together ceramic crystals. Ceramic particles 270, may include for example agglomerated alumina particles having a nominal diameter of between about 10 and about 250 microns (μm), for example, about 150 μm. In one example, the ceramic particles 270 are agglomerated ceramic particles, which are unground calcined alumina particles. A photograph of an agglomerated unground calcined alumina particle with a nominal diameter of about 150 μm formed of bonded individual 20 μm crystals, is shown in FIG. 8. Unground calcined alumina particles are readily available as a raw inexpensive material and have an added benefit of having rough "petal" like structures, which is believed, to create additional voids within the ceramic particles 270 for infiltration by the metal matrix 104, which may contribute to the overall stiffness of the resulting reinforced metal matrix composite 200.

The methods described with reference to FIG. 5 are also applicable for forming reinforced metal matrix composite 200. If ceramic particles 270 are to be used, the ceramic particles 270 may be added to the liquified metal matrix 104*b* to form a slurry with liquified metal matrix 104*b* prior to infiltration of the metal matrix 104 into the porous ceramic reinforcement 102. Alternatively, or in addition to adding the ceramic particles 270 to the liquified metal matrix 104*b*, the ceramic particles 270 may be added as a powder to the porous ceramic reinforcement 102 prior to infiltration by the metal matrix 104. Then, upon infiltration (either from metal matrix 104*a* or 104*b*) the ceramic particles 270 will be distributed throughout the porous ceramic reinforcement 102 with the metal matrix 104 as shown, for example, in FIG. 7.

The resulting reinforced metal matrix composite 200 may have, for example, between about 0 percent to about 35 percent by volume, for example, between about 20 percent to about 30 percent by volume, or, for example, about 25 percent by volume of the ceramic particle 270 in the metal matrix 104.

Figure 9:
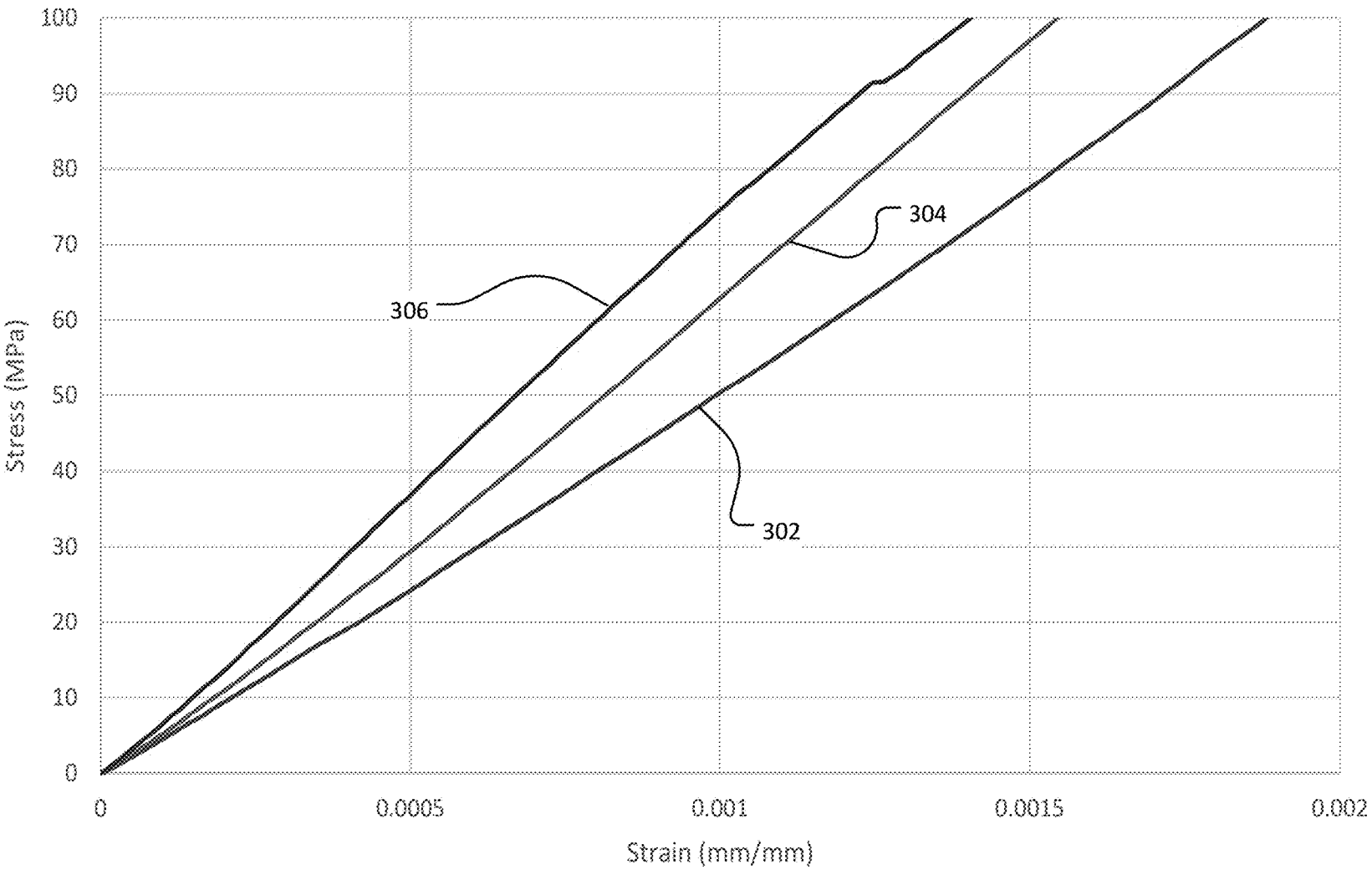
FIG. 9 is a stress-strain graph, in accordance with disclosed embodiments.

FIG. 9 shows stress/strain flexural curves determined from a four-point bend test similar to that described in ASTM C1161 showing the stiffness of: 6601 aluminum (curve 302); a reinforced MMC using 150 μm agglomerated aluminum oxide particles (curve 304); and an example reinforced metal matrix composite 200 having an aluminum metal matrix 204, an aluminum oxide porous ceramic reinforcement 102 having 30 pores per inch, and 150 μm agglomerated aluminum oxide particles as ceramic particles 270 (curve 306). The reinforced MMC using agglomerated aluminum oxide particles of curve 304 and the example reinforced metal matrix composite 200 of curve 306 each, nominally, have the same total volume percentage of aluminum oxide. As shown, the stiffness/ductility of a composite can be adjusted as desired by utilizing porous ceramic reinforcement, ceramic particles (for example, agglomerated aluminum oxide particles), or a combination of the two.

It should be noted that elements and features described with one example embodiment are applicable to other example embodiments.

What is claimed as new and desired to be protected by Letters Patent of the United States is:

1. A reinforced metal matrix composite comprising;

a porous ceramic reinforcement having pores therein; and a metal matrix in interstitial contact with the ceramic reinforcement within the pores, wherein the metal matrix comprises ceramic particles in an amount of from 20% to 30% by volume of the metal matrix therein, the ceramic particles are distributed throughout the metal matrix, the ceramic particles comprise agglomerated aluminum oxide particles, and wherein the agglomerated aluminum oxide particles comprise bonded aluminum oxide crystals having a diameter of from 100 microns to 200 microns.

2. The composite of claim 1, wherein the porous ceramic reinforcement is interconnected.

3. The composite of claim 2, wherein the porous ceramic reinforcement is continuous from a first end of the reinforced metal matrix composite to a second end of the reinforced metal matrix composite.

4. The composite of claim 1, wherein the porous ceramic reinforcement is from 10% to 20% by volume of the reinforced metal matrix composite.

5. The composite of claim 1, wherein a size of the pores is from 10 pores per inch (PPI) to 50 PPI.

6. The composite of claim 1, wherein the ceramic reinforcement has a nominal porosity of 80%.

7. The composite of claim 1, wherein the metal matrix comprises aluminum.

8. The composite of claim 1, wherein the porous ceramic reinforcement comprises aluminum oxide.

9. The composite of claim 1, wherein the ceramic particles are within the metal matrix within the pores.

10. The composite of claim 1, wherein the metal matrix comprises a metal alloy.

11. A method of forming the reinforced metal matrix composite of claim 1, the method comprising:

providing the porous ceramic reinforcement having pores therein;

contacting the porous ceramic reinforcement with a liquid metal matrix; and solidifying the liquid metal matrix into the metal matrix.

12. The method of claim 11, wherein providing a porous ceramic reinforcement comprises applying a ceramic to a polymer foam and sintering the ceramic.

13. The method of claim 11, further comprising adding ceramic particles to the liquid metal matrix.

14. The method of claim 13, wherein the ceramic particles are added to the porous ceramic reinforcement prior to the liquid metal matrix.

15. The method of claim 13, wherein the ceramic particles are added to the liquid metal matrix prior to contacting the porous ceramic reinforcement with the liquid metal matrix.

16. The method of claim 11, wherein the porous ceramic reinforcement is interconnected.

17. The composite of claim 16, wherein the porous ceramic reinforcement is continuous from a first end of the reinforced metal matrix composite to a second end of the reinforced metal matrix composite.

18. The method of claim 11, wherein a size of the pores is from about 10 pores per inch (PPI) to about 50 PPI.

19. The method of claim 11, wherein the ceramic reinforcement has a nominal porosity of about 80%.

20. The method of claim 11, wherein the metal matrix comprises aluminum.

21. The method of claim 11, wherein the porous ceramic reinforcement comprises aluminum oxide.

22. The method of claim 11, further comprising machining at least one surface of the reinforced metal matrix composite.

* * * * *